United States Patent [19]

Cooksey

[11] Patent Number: 4,921,044

[45] Date of Patent: May 1, 1990

[54] WELL INJECTION SYSTEMS

[75] Inventor: Andrew G. Cooksey, Coppell, Tex.

[73] Assignee: Otis Engineering Corporation, Dallas, Tex.

[21] Appl. No.: 23,237

[22] Filed: Mar. 9, 1987

[51] Int. Cl.[5] ..... E21B 43/12

[52] U.S. Cl. ..... 166/116; 166/142; 166/214; 166/222; 166/237; 166/242

[58] Field of Search ..... 166/115, 116, 136, 142, 166/214, 237, 240, 242, 313, 316, 322, 320, 222

[56] References Cited

U.S. PATENT DOCUMENTS

| | | | |
|---|---|---|---|
| 2,766,831 | 10/1956 | Otis | 166/237 X |
| 2,923,357 | 2/1960 | Daffin | 166/313 X |
| 3,105,556 | 10/1963 | Raulins | 166/214 |
| 3,268,239 | 8/1966 | Castor et al. | 166/237 X |
| 3,371,717 | 3/1968 | Chenoweth | 166/320 X |
| 3,414,071 | 12/1968 | Alberts | 166/214 X |
| 3,455,380 | 7/1969 | Salerni et al. | 166/115 |
| 3,661,206 | 5/1972 | Putch et al. | 166/313 |
| 4,473,122 | 9/1984 | Tamplen | 166/322 X |
| 4,508,174 | 4/1985 | Skinner et al. | 166/250 X |

*Primary Examiner*—Hoang C. Dang
*Attorney, Agent, or Firm*—Roland O. Cox

[57] ABSTRACT

Disclosed are selective and no-go systems for injecting fluids in a well and a system for orienting a tool in a landing nipple in a well conduit, which is utilized in the selective set injection system. Each injection system is comprised of a land nipple, an injection mandrel having openings for flow and an orientor. The landing nipples have wall openings for flow and orienting means which are engaged by the mandrel orientor as the mandrel is lowered into the landing nipple, orienting the mandrel and aligning the mandrel flow openings with the nipple flow openings. There are orifices in the flow openings in both mandrels to control injected flow through the mandrel. The system for orienting a tool in a landing nipple has an orientor attachable to a well tool. This orientor and the selective orientor have lugs which engage an orienting sleeve in the nipple and are guided into slots when lowered into the sleeve. The slot bottoms have camming surfaces which cam the lugs inwardly permitting the orientor and selective injection mandrel to be lowered through their nipples.

14 Claims, 4 Drawing Sheets

WELL INJECTION SYSTEMS

BACKGROUND OF THE INVENTION

1. Technical Field

The present invention concerns systems useful in earth wells. This invention more specifically concerns well injection systems useful for injecting fluids in a formation encountered by an earth well bore.

2. Background Art

Various systems have been used in earth wells to pump fluids down well flow conduits for "injection" into a formation. The fluids, either liquid or gas, are usually required in larger volumes for Enhanced Oil Recovery operations, such as water, steam and $CO_2$ injection into selected wells in a formation to "flood" the formation or reservoir to ultimately cause recovery of greater quantities of hydrocarbons from the formation than if usual recovery methods were used.

U.S. Pat. No. 4,355,686 to Henry P. Arendt and Thomas J. Heard discloses a method of operating an injection well and apparatus used in the well. This patent teaches injection through a well flow conduit into a formation after a plug is expended from the conduit, but suggests no way of controlling injected flow rates.

SUMMARY

Both injection systems of the present invention will permit large quantity fluid injection into a formation with control of injected flow rates by multiple orifices. The orifices are housed in injection mandrels, which may be retrieved from cooperating landing nipples in the well flow conduit and orifice sizes changed for any required changes in injection rates. The landing nipples are included in well flow conduits and more than one nipple may be used in a conduit. Each landing nipple is installed in the well in sealed communication with a formation by setting packers in the well casing. Fluids to be injected in formations are pumped down the flow conduit, into and through the injection mandrel orifices, through openings for flow in the nipple walls, the tubing-casing annulus, casing perforations and into the formation.

Each injection mandrel includes a lock mandrel, openings for flow through the mandrel walls, an orifice in each opening and an orientor. The lock mandrels used are of the type usually lowered into a well conduit on wireline to land, seal and be releasably locked in a "no-go" landing nipple in the well conduit or caused to "select" a particular landing nipple from a number of identical landing nipples in a well conduit to seal and be releasably locked in. Both landing nipples have openings for flow through the nipple walls and orientors which engage the injection mandrel orientors to orient and align the injection mandrel and nipple flow openings when the injection mandrel is lowered into the nipple.

The no-go landing nipple has an internal profile in which a no-go type lock mandrel may seal and be releasably locked and orienting pins which engage orienting slots between flow openings on the no-go injection mandrel orientor.

The selective landing nipple has an internal profile in which a selective type lock mandrel may seal and be releasably locked and an internal orienting sleeve. This sleeve has openings and slots whose sides are camming surfaces which are engaged by lugs on the selective injection mandrel orientor as it is lowered into the selected nipple. The lugs, orientor and mandrel are rotated by the camming surfaces, aligning the openings for flow in the mandrel and nipple when the selective lock has sealed and landed in the nipple profile.

Each orienting lug in the selective mandrel orientor has a lower "lead-in" and an upper "lead-out" tapered surface on its outer surface. The lugs are slidably mounted for inward and outward movement in holes in the orientor mandrel and are biased outwardly. There is a camming surface in each nipple sleeve slot bottom which contacts the lug lead-in surface and cams the lug inwardly permitting the orientor and injection mandrel to be lowered through a selective landing nipple. Each lug also has side flat surfaces which engage the internal orienting sleeve opening and slot side camming surfaces when the mandrel is lowered into a selective nipple to turn the mandrel and align the orifices with flow openings in the nipple.

It should be apparent to all skilled in well injection and production art, that the injection systems disclosed in this application could also be used as production systems with the mandrel orifices controlling production rate or flow from a well formation upwardly to surface in a well conduit.

An object of this invention is to provide well injection systems through which large quantities of fluid may be injected.

Also an object of this invention is to provide well injection systems having means for controlling the rate of the large quantities injected.

Another object of this invention is to provide injection systems utilizing both no-go and selective locking systems.

Also an object of this invention is to provide an injection mandrel useful with a selective locking system, which may be lowered through a nipple and locked in a lower nipple in the well conduit.

Another object of this invention is to provide injection systems having injection mandrels with orientors which orient and align openings for injection flow when lowered into a landing nipple in the well conduit.

Also an object of this invention is to provide an orientor attachable to a well tool which will orient and align the tool when lowered into a landing nipple in the well conduit.

DESCRIPTION OF THE PREFERRED EMBODIMENTS

Figure 1:
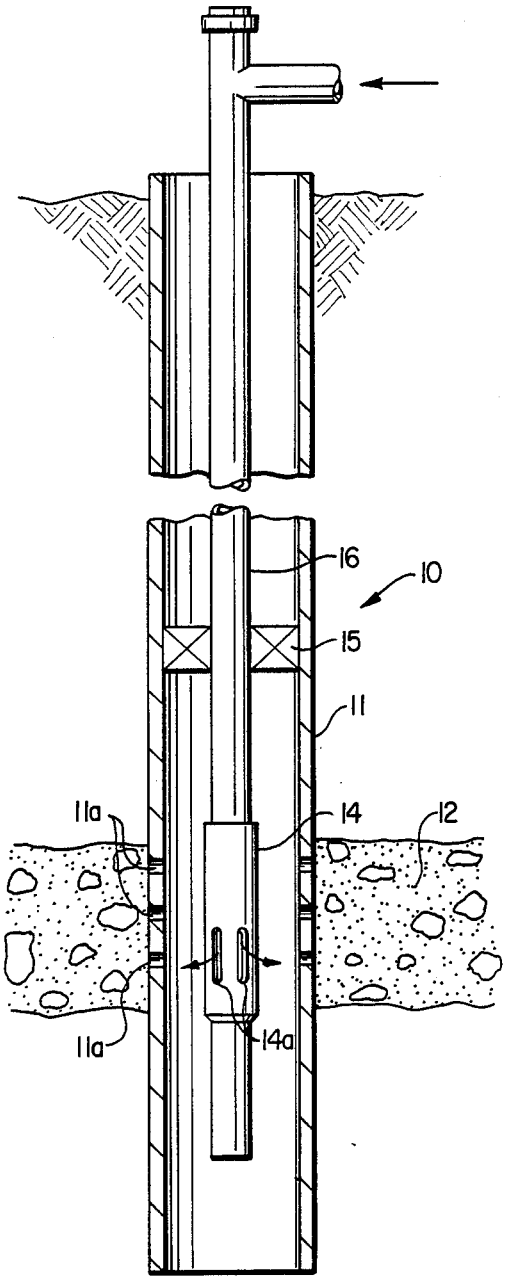
FIG. 1 is a sectioned schematic drawing of a well utilizing the injection systems of this invention.

FIG. 1 shows an earth well 10 having a casing 11, with perforations 11*a*, in the bored hole which passes through a formation 12. A landing nipple 14 having wall openings 14*a* and a packer 15 have been made up in a flow conduit 16 and lowered into the well. The packer has been operated to grip and seal to the inside of the casing. Fluids to be injected into the formation are introduced into the flow conduit on the surface and pumped down the conduit, out through nipple openings 14*a*, through perforations 11*a* and into formation 12.

Figure 2A:
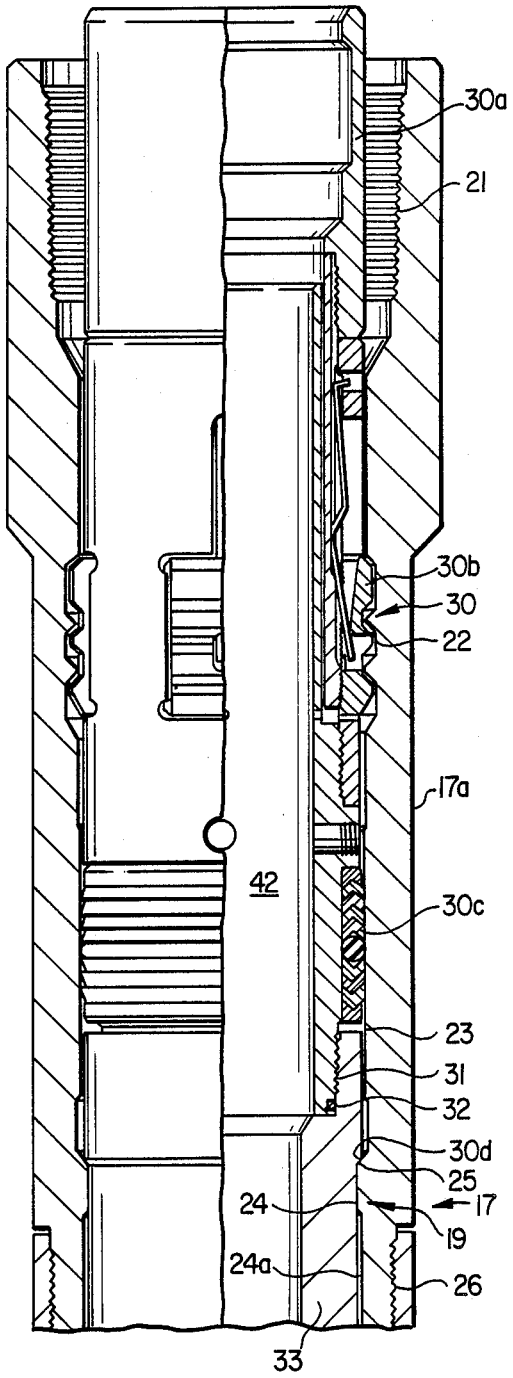
FIGS. 2A and 2B is a partially sectioned drawing of an injection mandrel of this invention locked in a no-go type landing nipple.
Figure 2B:
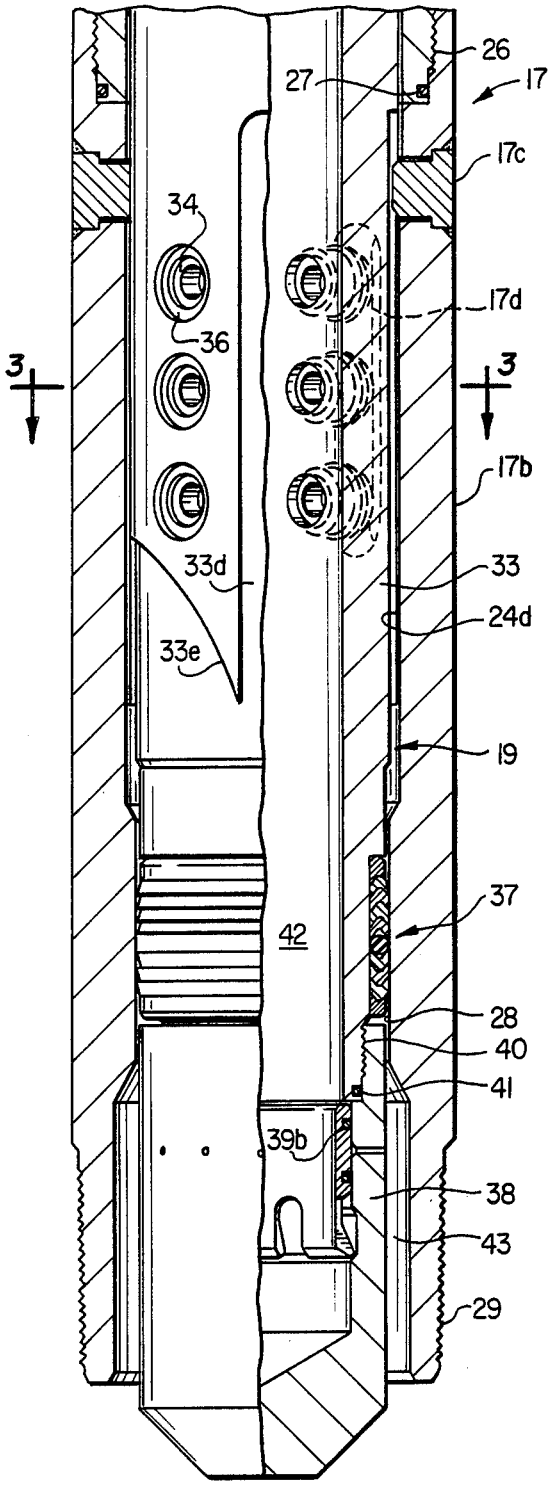
Figure 4A:
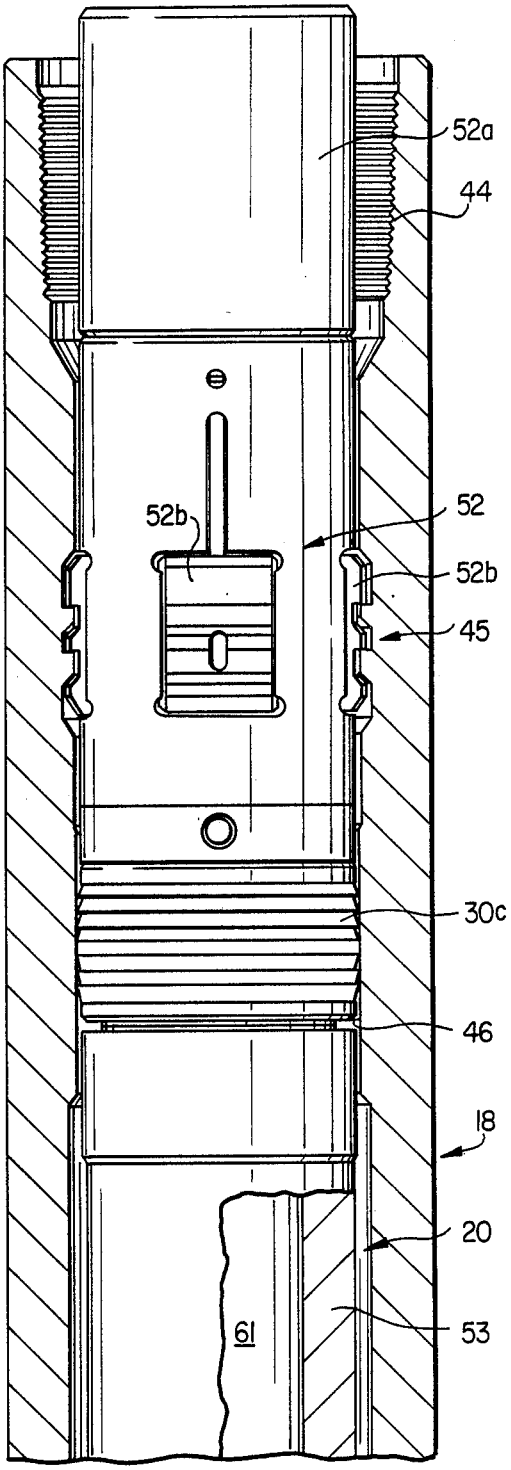
FIGS. 4A and 4B is a partially sectioned drawing of an injection mandrel of this invention locked in a selective type landing nipple.
Figure 4B:
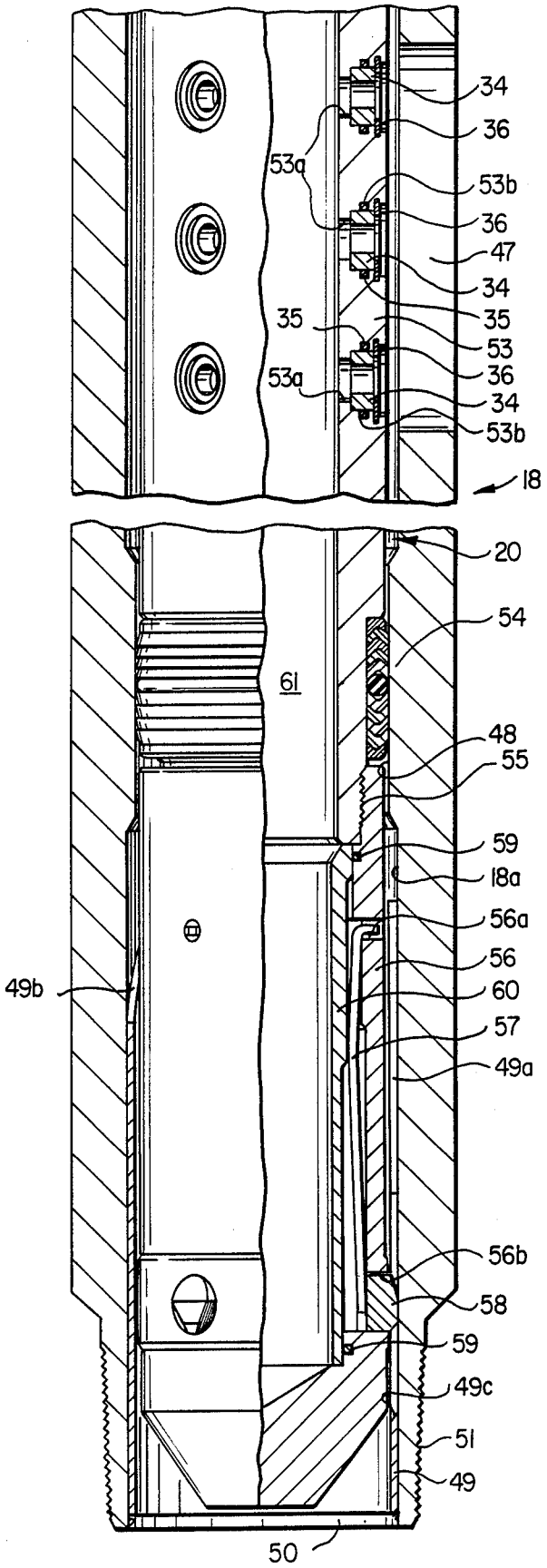

The landing nipple in the flow conduit may be a no-go type, 17 shown in FIGS. 2A and 2B or a selective type 18, shown in FIGS. 4A and 4B. An injection mandrel 19 is shown oriented, sealing and locked in nipple 17 in FIGS. 2A and 2B. An injection mandrel 20 is shown oriented, sealing and locked in nipple 18 in FIGS. 4A and 4B.

Figure 3:
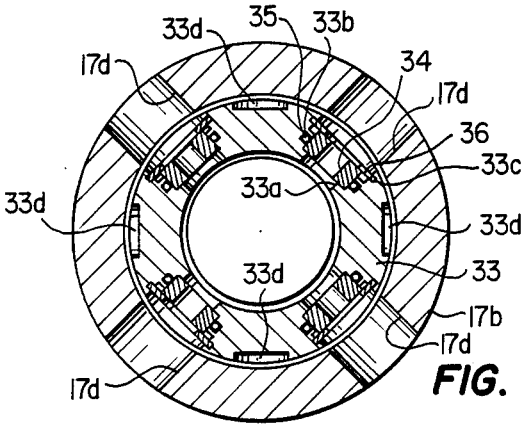
FIG. 3 is a cross section drawing of the nipple and mandrel of FIGS. 2A and 2B on line 3—3 of FIG. 2B and viewed as indicated.

The no-go landing nipple 17 has an upper section 17*a* which is internally profiled as a no-go type X® landing nipple (X is a registered trademark of Otis Engineering Corp.) This upper section has an appropriate thread 21 for connection into the flow conduit, internal grooving 22 having a particular profile, a seal bore 23 and a bore 24 smaller than bore 23 providing a no-go shoulder 25 between bores 23 and 24. Threads 26 connect upper nipple section 17*a* to lower nipple section 17*b* and resilient seal 27 seals section 17*a* in 17*b*. The lower nipple section has a number of pins 17*c* protruding into overbore 24*a* to a diameter less than bore 24, a number of slots or wall openings 17*d*, (see also FIG. 3), a lower bore 28 for seals and an appropriate lower connecting thread 29.

The injection mandrel 19 includes an X® no-go type lock mandrel 30 which has a fishing neck 30*a*, engageable by X® running tools and pulling tools, keys 30*b* profiled to engage grooving 22, a seal system 30*c* sealingly engageable in seal bore 23 and a no-go shoulder 30*d*, which lands on nipple shoulder 25.

Connected to the lower end of the lock mandrel by thread 31 and sealed with resilient seal 32, is an orifice mandrel 33. As shown best by FIG. 3, the orifice mandrel has wall holes 33*a*; each of these holes has two counterbores. Groove 33*b* is in the smaller counterbore and groove 33*c* is in the larger. A flow restrictor or orifice 34 has been installed in the smaller counterbore in each hole 33*a* and is sealed to mandrel 33 with resilient seal 35 and retained therein with retaining ring 36 positioned in groove 33*c*. Orifice mandrel 33 also has aligning slots 33*d* and camming surfaces 33*e* connecting the slots. A seal system 37 on the mandrel sealingly engages the mandrel and bore 28 in the landing nipple. A cap 38, housing a closed equalizing valve 39, is connected to the lower end of the mandrel with thread 40 and is sealed to the mandrel with resilient seal 41. The equalizing valve has a slidable valve member 39*a* and resilient seals 39*b*. Cap 38 has a number of wall openings through which flow may occur between the interior of the mandrel 42 and the annulus 43 when the equalizing valve is moved downwardly until upper resilient seal 39*b* is below openings 38*a*.

The landing nipple 18, shown in FIGS. 4A and 4B, has an upper internal selective type X® profile and an appropriate thread 44 for connection in a flow conduit. Below the grooving 45 is a seal bore 46. This selective landing nipple also has a number of slots or wall flow openings 47 and a seal bore 48. Positioned in lower bore 18*a* of nipple 18 is an orienting sleeve 49, which is welded to the nipple at 50. This sleeve has a number of aligning slots 49*a*, camming surfaces 49*b* between the slots and inward camming surfaces 49*c* in the lower end of the slots. On the lower end of nipple 18 is an appropriate thread 51 for connecting this nipple in a flow conduit.

A selective type injection mandrel 20 is shown installed in nipple 18 in FIGS. 4A and 4B. This injection mandrel includes an X® selective type lock mandrel 52, which has an internal fishing neck 52*a* engageable by X® running tools and pulling tools, keys 52*b* engaging grooving 45 and a seal system 52*c*, which is sealingly engaged in nipple seal bore 46. Connected to the lower end of lock mandrel 52 is an orifice mandrel 53 which has wall holes 53*a*. Each of these holes has two counterbores; groove 53*b* is in the smaller counterbore and groove 53*c* is in the larger. A flow restrictor or orifice 34 has been installed in the small counterbore in each hole 53*a* and is sealed to the mandrel 53 with a resilient seal 35 and retained therein with a retaining ring 36 as the orifices 34 are in mandrel 33 shown in FIG. 3.

Returning to FIG. 4B, a seal system 54 seals on the mandrel and sealingly engages nipple bore 48. Connected to the lower end of mandrel 53 by threads 55 is an orienting mandrel 56. This orienting mandrel is closed at its lower end and has a number of upper openings 56*a* and lower openings 56*b*. Positioned by the upper openings are springs 57 and mounted for radial movement in the lower openings are orienting lugs 58. Upper and lower resilient seals 59 have been installed in grooves in orifice mandrel 56 to seal a sleeve 60 in the mandrel. The sleeve biases springs 57 and orienting lugs 58 outwardly. The interior of injection mandrel 20 is denoted by numeral 61.

Figure 7:
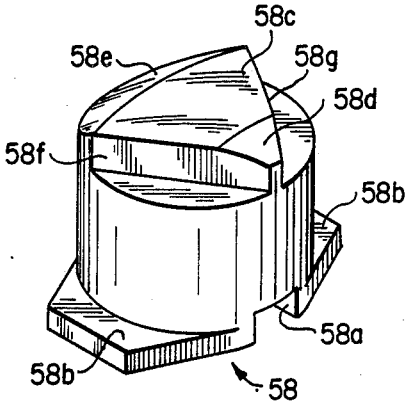
FIG. 7 is an isometric drawing of an orienting lug useful in the orientor of FIG. 5.

As may be seen in FIG. 7, each orienting lug has a slot 58*a* into which spring 57 protrudes and ears 58*b*, which prevent the lugs from being pushed out of openings 56*b*. Each lug also has a radial outer surface 58*c*, a chamfered lead-in surface 58*d* and a chamfered lead-out surface 58*e*. These lead-in and lead-out surfaces cam the lugs inwardly to permit passage through restrictions and sliding by any square shoulders encountered in the flow conduit while the selective injection mandrel 18 is being lowered or raised from an engageable nipple in the flow conduit. When it is desirable to lower a selective injection mandrel through a selective type landing nipple, slot end camming surface 49*c* contacts orienting lug lead-in surfaces 58*d* and cams the lugs inwardly for passage of the injection mandrel downwardly through the nipple 18. Each lug 58 also has flat camming surfaces 58*f* and 58*g*.

Figure 5:
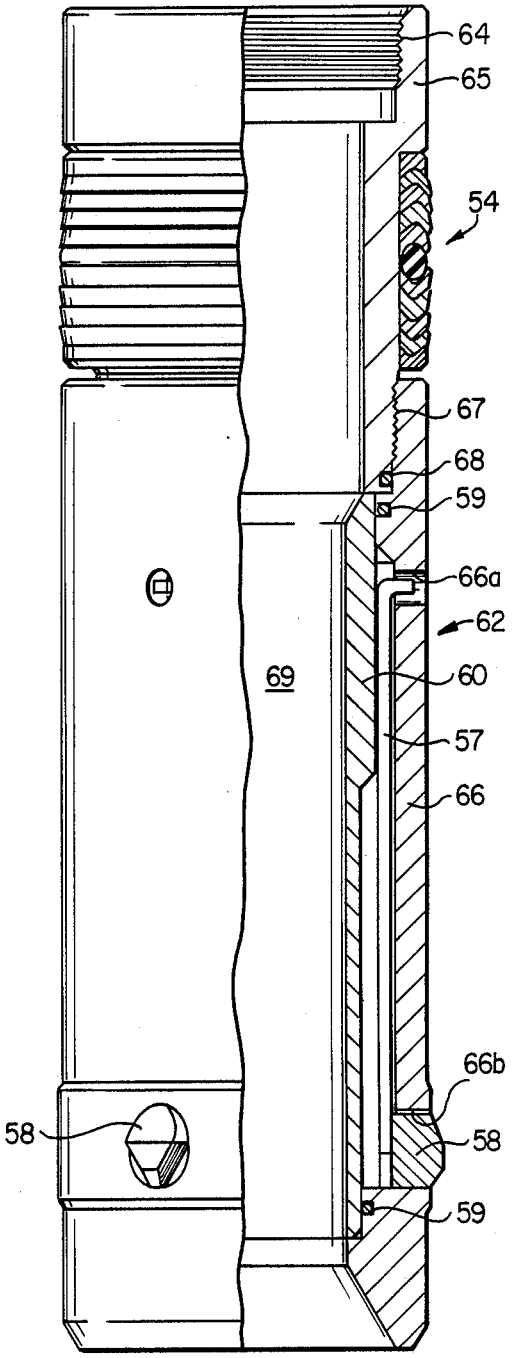
FIG. 5 is a half sectioned drawing of an orientor of this invention.
Figure 6:
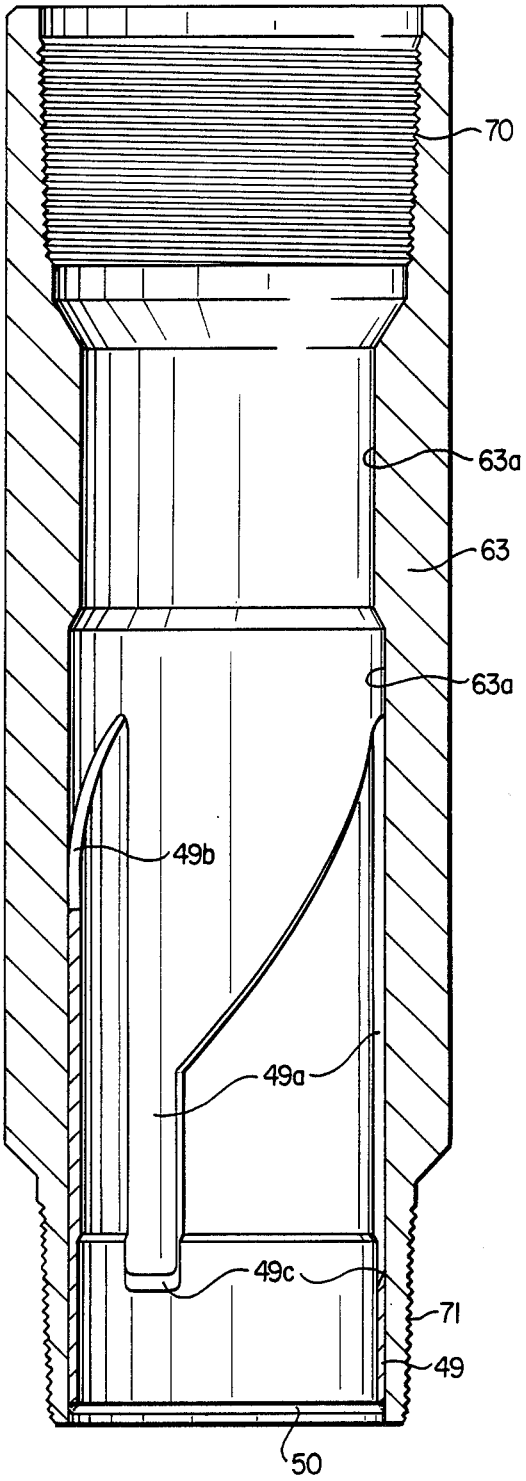
FIG. 6 is a drawing in section of a landing nipple engageable by the orientor of FIG. 5.

FIG. 5 is a drawing of an orientor 62 which attaches to any well tool which requires orienting in a well flow conduit. FIG. 6 is a drawing of an orienting nipple 63, which may be engaged by orientor 62 and is connected in the well flow conductor.

The orientor has an appropriate thread 64 for connection to the well tool in the upper end packing mandrel 65. Another seal system 54 seals around the mandrel and is sealingly engageable in seal bore 63*a* in orienting nipple 63. An orienting mandrel 66 is connected to the packing mandrel by thread 67 and is sealed to it by resilient seal 68. Orienting mandrel 66 is the same as orienting mandrel 56 except mandrel 66 has an open lower end permitting longitudinal flow in passage 69 through orientor 62. Nipple 63 includes an upper thread 70 and a lower thread 71 for connection in a flow conduit.

Mandrel 66 (as mandrel 56) has upper and lower openings 66*a* and 66*b*. Positioned in 66*a* are more springs 57 and mounted for radial movement in openings 66*b* are orienting lugs 58. Resilient seals 59 seal sleeve 60 in the mandrel and this sleeve biases springs 57 and lugs 58 outwardly.

Landing nipple 63 has an orienting sleeve 49 positioned in nipple bore 63*a* and welded to the nipple at 50. Sleeve 49 has aligning slots 49*a*, camming surfaces 49*b* and inward camming surfaces 49*c* in the lower slot ends.

To use the no-go injection mandrel and nipple of FIGS. 2A and 2B in the system of FIG. 1, no-go nipple 17 would be used as the nipple 14 in the flow conduit 16 of FIG. 1. Orifices 34, sized to permit desired injection rates, are selected and installed in no-go injection mandrel 19. A particular system may not require equalizing valve 39 and cap 38 on the lower end of the injection mandrel. The lower end may be closed as is orienting mandrel 56 of FIG. 4B or open for flow as is orienting mandrel 66 in FIG. 5. The injection mandrel is attached to a running tool and lowered in conduit 16 and into nipple 17 until aligning slots 33*d* in the orientor mandrel move down in nipple pins 17*c* or more probably, camming surfaces 33*e* contact nipple pins 17*c*. On further downward movement of injection mandrel 19, camming surfaces 33*e* sliding on pins 17*c* rotate the injection mandrel until the slots may move down in the pins, seal system 37 moves into seal bore 28, seal system 30C moves into seal bore 23 and orifices 34 are aligned with nipple wall openings 17*d*. Downward movement of the injection mandrel stops when lock mandrel no-go 30*d* contacts nipple shoulder 25. Lock mandrel keys 30*b* are now opposite grooving 22 and the lock mandrel may be operated to lock the keys and injection mandrel 19 in landing nipple 17.

Fluids to be injected into the formation may now be introduced into the flow conduit at surface and be pumped down into the interior 42 of injection 19 to flow out through orifices 34, nipple wall openings 17*d*, through perforations 11*a* and into formation 12. Those skilled in well production art will recognize the injection system just described could as well be utilized as a production system with large production outflow rates controlled by orifices 34.

When it is necessary to retrieve injection mandrel 19 to surface for changing orifice sizes and injected flow rate or for maintenance, a pulling tool engageable with lock mandrel fish neck 30*a* and carrying a prong which will open equalizing valve 39, is lowered into the mandrel, opening the equalizing valve and engaging the fish neck to permit lock mandrel 30 to be unlocked from nipple 17 and injection mandrel 19 to be raised back to surface.

To use the selective injection mandrel and nipple of FIGS. 4A and 4B in the system of FIG. 1, selective nipple 18 would be used as the nipple 14 in the flow conduit 16 of FIG. 1. Orifices 34, sized to permit desired injection (or production) rates, are selected and installed in selective injection mandrel 20 on surface. This injection mandrel is attached to an appropriate running tool and lowered in conduit 16 and into nipple 18 until orienting lugs 58 more down in sleeve slots 49*a* or most likely, lug surfaces 58*f* or 58*g* will contact sleeve camming surfaces 49*b*. On further movement down of injection mandrel 20, orienting surfaces 58*f* or 58*g* sliding down surfaces 49*b* rotate the injection mandrel until lugs 58 move down in 49*a*, seal system 54 moves into seal bore 48, seal system 30*c* moves into seal bore 46 and orifices 34 are aligned with nipple wall flow openings 47. Downward movement of the injection mandrel stops when selective lock keys 52*b* land in nipple grooving 45. Lock mandrel 52 is operated to lock the keys in grooving 45 and injection mandrel 20 in selective landing nipple 18. If it desired to not lock the selective injection mandrel in an upper nipple, it may be lowered through the selective nipple and locked in any compatible nipple below as nipple camming surfaces 49*c* cam lugs 58 inwardly to permit the mandrel to pass through the nipple.

Fluids to be injected into the well formation may now be pumped down the flow conduit into the interior 61 of injection mandrel 20, out through orifices 34 and nipple wall openings 47, through perforations 11*a* and into formation 12. Again, those skilled in well production art will recognize the selective injection system could just as well be utilized as a production system with production flow rate to surface controlled by orifices 34. Equalizing valve 39 with cap 38 may be attached to the lower end of orifice mandrel 56 or the lower end may be left open as the system requires. Selective injection mandrel 20 may be retrieved to surface using methods previously described for no-go mandrel 19.

To use the orientor 62 of FIG. 5 in the orienting landing nipple 63 of FIG. 6, the nipple should be connected into the flow conduit and lowered into the well. The orientor is connected to the tool requiring orientation and lowered down the flow conduit and into the nipple. Lugs 58 slide down into positioning slots 49*a* or lug flat surfaces 58*f* or 58*g* contact camming surfaces 49*b* and as orientor 62 is lowered further into nipple 63, the lug flat surfaces sliding down surfaces 49*b* turn orientor 62 and the well tool to align lugs 58 for lowering into slots 49*a*. When desired, orientor 62 may be retrieved or lowered through nipple 63. When the orientor is lowered lug surface 58*d* contacts slot end surface 49*c* and cams the lugs inwardly.

I claim:

1. A well system comprising:

(a) a casing in the well, said casing having perforations opposite an earth formation;

(b) a flow conduit in said casing;

(c) a packer on said flow conduit, said packer set in said casing above said formation;

(d) perforations below said packer in said casing, said perforations communicating said formation with the inside of said casing;

(e) a landing nipple in said flow conduit below said packer, said nipple having therein
upper profiled grooving,
a seal bore below said grooving,
a no-go landing shoulder below said bore,
orienting pins below said shoulder,
wall flow openings in said nipple below said pins, and
a smaller seal bore below said openings,
said orienting pins above said lower seal bore; and (f) mandrel means for landing in said nipple including a lock mandrel having seals thereon for locking and sealing said mandrel means in said nipple, said mandrel means having wall flow openings and orienting means coengageable with said nipple orienting pins for orienting said mandrel means when landed in said nipple to align said nipple and mandrel means wall flow openings so that fluid may flow between said formation and the inside of said flow conduit through said flow openings and perforations.

2. Apparatus for injecting fluids in a well having a flow conduit therein comprising:

(a) a landing nipple in said flow conduit, said nipple having therein
upper profiled grooving,
a seal bore below said grooving,
a no-go landing shoulder below said bore,
orienting pins below said shoulder,
wall flow openings below said pins,
a smaller seal bore below said openings; and (b) mandrel means for landing in said nipple including, a lock mandrel having seals thereon for locking and sealing said mandrel means in said nipple, said mandrel means having wall flow openings, and orienting means coengageable with said nipple orienting pins for orienting said mandrel means when landed in said nipple to align said nipple and mandrel means flow openings so that fluid may flow between the inside of the flow conduit and outside of said landing nipple through said flow openings.

3. The apparatus of claim 2 wherein the mandrel means further comprise:

(a) a tubular member connected to the lower end of the lock mandrel, said member having said wall flow openings therethrough, each said opening having a bore, inner and outer grooves and orifice means therein, and said orienting means thereon and a no-go landing shoulder thereon above said flow openings;

(b) seals on said member below said flow openings and said orienting means; and (c) an equalizing valve connected to the lower end of said member.

4. The apparatus of claim 3 wherein the orifice means comprise:

(a) an orifice in each bore;

(b) a resilient seal in each inner groove; and (c) a retaining ring in each outer groove retaining each orifice in each flow opening.

5. The apparatus of claim 3 wherein the orienting means are grooves on the tubular member.

6. The apparatus of claim 5 wherein the orienting grooves are disposed between the flow openings around the tubular member.

7. Apparatus for injecting fluids in a well having a flow conduit therein comprising:

(a) a landing nipple having upper and lower connections for connecting said nipple in the flow conduit, upper profiled grooving, a seal bore below said grooving, a no-go landing shoulder below said seal bore, orienting pins below said shoulder, wall flow openings below said shoulder, a smaller seal bore below said flow openings, said orienting pins protruding into said nipple to a diameter slightly larger than said smaller seal bore; and (b) mandrel means including a lock mandrel having seals thereon for locking and sealing said mandrel means in said nipple, (c) a tubular member connected to the lower end of said lock mandrel, said member having a no-go shoulder thereon, and wall flow openings therethrough, each opening having a bore, an inner groove and an outer groove therein and an orifice in each said bore, a resilient seal in each said inner groove and a retaining ring in each said outer groove, and orienting grooves on said tubular member coengageable with said nipple pins for orienting and aligning said nipple and tubular member flow openings when said mandrel means is landed in said nipple, seals on said tubular member below said orienting grooves, and an equalizing valve connected to the lower end of said tubular member.

8. Apparatus for injecting fluids in a well having a flow conduit therein comprising:

(a) a landing nipple in the flow conduit; said nipple having therein upper profiled grooving, a seal bore below said grooving, wall flow openings therethrough below said seal bore, a lower seal bore equal in diameter to said seal bore, and orienting means below said lower seal bore in said nipple, said orienting means including a sleeve connected in said nipple, said sleeve having slots therethrough, camming surfaces between said slots and in one end of each slot; and (b) mandrel means for landing in said nipple including a lock mandrel having seals thereon for locking and sealing said mandrel means in said nipple, said mandrel means including, wall flow openings with orifice means therein for controlling flow through said openings, and orienting means coengageable with said nipple orienting means for orienting said mandrel means when landed in said nipple to align said nipple and mandrel means flow openings so that fluid may flow between the inside of the flow conduit and the outside of said landing nipple through said flow openings.

9. The apparatus of claim 8 wherein the mandrel means further comprise:

(a) a tubular member having said flow openings therethrough connected between the lower end of the lock mandrel and the orienting means, each said opening having inner and outer grooves and orifice means therein for controlling flow through said openings; and (b) seals on said tubular member below said openings.

10. The apparatus of claim 9 wherein the orifice means comprise:

(a) an orifice in each opening;

(b) a resilient seal in each inner groove; and (c) a retainer ring in each outer groove.

11. The apparatus of claim 9 wherein the mandrel orienting means comprise:

(a) a mandrel, closed on its lower end and connected to the lower end of said tubular member and having spaced apart upper and lower holes through the walls thereof;

(b) an orienting lug mounted for inward and outward movement in each lower hole;

(c) a spring positioned by each upper hole and contacting each lug; and (d) a sleeve positioned inside said springs and sealed to said mandrel above said upper holes and below said lower holes, said sleeve biasing said springs and lugs outwardly.

12. The apparatus of claim 11 wherein each orienting lug has a cylindrical body and a flat inner surface having a slot therein and ears extending therefrom, said lug having an outer surface, said surface having lead-in and lead-out surfaces and a pair of flat upwardly divergent orienting camming surfaces thereon.

13. Apparatus for injecting fluids in a well having a flow conduit therein comprising:

(a) a landing nipple having upper and lower connections for connecting said nipple in the flow conduit, upper profiled grooving, a seal bore below said grooving, wall flow openings below said bore, a lower seal bore equal in diameter to said seal bore below said openings, and an orienting sleeve connected below said lower seal bore in said nipple, said sleeve having slots therethrough, camming surfaces between said slots and in the end of each slot; and (b) mandrel means including a lock mandrel having seals thereon for locking and sealing said mandrel means in said nipple; including a tubular member connected to the lower end of said lock mandrel, said member having wall flow openings therethrough, each opening having a bore, an inner groove and an outer groove therein, an orifice in each said bore, a resilient seal in each said inner groove, and a retaining ring in each said outer groove, and orienting means engageable with said nipple orienting sleeve for orienting and aligning said nipple and tubular member flow openings when said mandrel means is landed in said nipple, said orienting means including a mandrel, closed on its lower end and connected to the lower end of said tubular member, said mandrel having spaced apart upper and lower holes through the wall thereof, an orienting lug mounted for inward and outward movement in each lower hole, each said orienting lug having a cylindrical body and a flat inner surface with a slot therein, and ears extending therefrom, and each said lug having an outer surface, said outer surface having lead-in and lead-out surfaces for camming said lug inwardly and a pair of flat upwardly divergent orienting camming surfaces thereon.

14. A well system comprising:

(a) a casing in the well, said casing having perforations opposite an earth formation;

(b) a flow conduit in said casing;

(c) a packer on said flow conduit, said packer set in said casing above said formation;

(d) perforations below said packer in said casing, said perforations communicating said formation with the inside of said casing;

(e) a landing nipple in said flow conduit below said packer, said nipple having therein
upper profiled grooving,
a seal bore below said grooving,
wall flow openings in said nipple below said seal bore,
a lower seal bore therein below said wall flow openings, and
orienting means connected in said nipple below said lower seal bore including,
a sleeve having slots therethrough,
camming surfaces between said slots and in one end of each slot; and (f) mandrel means for landing in said nipple including a lock mandrel having seals thereon for locking and sealing said mandrel means in said nipple, said mandrel means having wall flow openings and orienting means coengageable with said nipple orienting means for orienting said mandrel means when landed in said nipple to align said nipple and mandrel means wall flow openings so that fluid may flow between said formation and the inside of said flow conduit through said flow openings and perforations.

* * * * *